United States Patent [19]

Madnick et al.

[11] Patent Number: 4,801,944

[45] Date of Patent: Jan. 31, 1989

[54] ANTENNA

[76] Inventors: Peter A. Madnick, 627 Valley Oak La.; Russell W. Sherwood, 1798 Allepo Ct., both of Thousand Oaks, Calif. 91360

[21] Appl. No.: 107,007

[22] Filed: Oct. 13, 1987

[51] Int. Cl.[4] ..... H01Q 11/12

[52] U.S. Cl. ..... 343/744; 343/741; 343/742; 343/748

[58] Field of Search ..... 343/744, 741, 742, 743, 343/748, 867

[56] References Cited

U.S. PATENT DOCUMENTS

| | | | |
|---|---|---|---|
| 2,469,209 | 5/1949 | Scheldorf | 343/744 |
| 2,474,238 | 6/1949 | Eck et al. | 343/867 |
| 2,610,296 | 9/1952 | Reid | 343/748 |
| 2,657,312 | 10/1953 | Saranga | 343/744 |
| 2,751,590 | 6/1956 | Troutman | 343/742 |
| 2,960,693 | 11/1960 | Fry | 343/840 |
| 3,281,847 | 10/1966 | Herrero | 343/702 |
| 3,573,830 | 4/1971 | Tadama et al. | 343/741 |
| 3,582,951 | 6/1971 | Altmayer | 343/744 |

*Primary Examiner*—William L. Sikes
*Assistant Examiner*—Hoanganh Le
*Attorney, Agent, or Firm*—Jack C. Munro

[57] ABSTRACT

An antenna which utilizes a conductive loop shaped element and a conductive tap element. The tap element is located directly adjacent the loop element and is precisely tapped to the loop element at one-half the length of the loop element. Connecting between the output terminal of the antenna and terminals of the loop element and the tap element are a plurality of tuning capacitors. The resulting antenna is small in size and is sensitive to a wide band of frequencies with respect to the center frequency of the antenna.

6 Claims, 1 Drawing Sheet

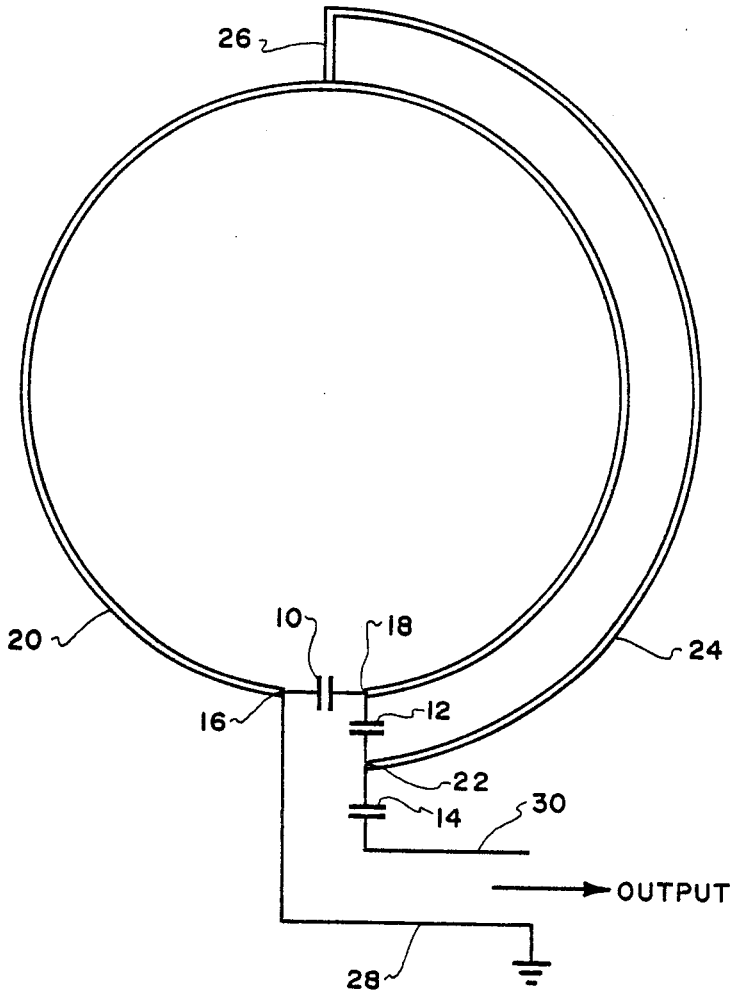
26
20
10
18
24
16
12
22
14
30
OUTPUT
28

ANTENNA

BACKGROUND OF THE INVENTION

The field of this invention relates generally to an antenna and more particularly to an antenna which is designed primarily to have particular utility when used with FM radio receivers.

An antenna is a device for transmitting or receiving radio waves. A transmitting antenna converts the electrical signals from a transmitter (radio, television or radar) into an electromagnetic wave, which spreads out from the transmitter. A receiving antenna intercepts this wave and converts it back into electrical signals, then amplified and decoded by a receiver, such as a radio, television or radar set.

A radio transmitter produces a signal in the form of an alternating electric current, that is one which oscillates rapidly back and forth along a wire. The rate of this oscillation can be anything from thousands of times a second to billions of times per second. This rate of oscillation is known as a frequency and is either measured in kilohertz (thousands of times a second) or, for higher frequencies, in megahertz (millions of times a second).

The oscillating current in the transmitting antenna produces an electromagnetic wave around it which spreads out from the antenna like the ripples in a pond. This wave sets up electric and magnetic fields. The lines of the electric field run along the antenna and those of the magnetic field around the antenna. Both the electric and magnetic fields oscillate in time with the electric current.

Wherever this wave comes into contact with a receiving antenna, it induces a small electric current in it which alternates back and forth along the receiving antenna in time with the oscillations of the wave. Although this current is much weaker than one in the transmitting antenna, it can be picked up by the amplifier of the radio to receive it.

The air is full of radio waves at all frequencies which the antenna picks up indiscriminately. Each receiver has a means of selecting a narrow band of frequencies at any time. This is what happens when a particular signal is tuned in. Each set can be tuned within a certain frequency range and will only respond to signals in that range. For example, common FM frequencies range from 88 to 108 mHz. It would be desirable to design the receiving antenna to be sensitive only to these frequencies.

Antennas are subject to resonance. What is meant by resonance is that the antenna may be relatively insensitive to much of the frequency range (for example 88 to 108 megahertz [mHz]), but between 95 and 97 mHz the antenna is exceedingly sensitive. Another antenna may be constructed to be sensitive between 89 and 91 while a third could be constructed to be sensitive between 102 and 104 mHz. Therefore, for a particular FM receiver to be sensitive to the full range of desired frequencies it would be necessary to utilize a plurality of different antennas in conjunction with a single receiver.

At 98 mHz, the electromagnetic wave produced is 120 inches in length. It will greatly increase the efficiency of the antenna if the length of the antenna is directly related to the wavelength of the signal it receives. However, it is just not feasible to construct antennas 120 inches in length. Therefore, it is common to utilize an antenna which has a length exactly one-half or one-quarter of the wave length it receives. However, even a thirty inch or sixty inch antenna is rather difficult to be utilized in conjunction with a receiver and, if it is desired to have that receiver to be sensitive to all frequencies within its receiving band, it will be necessary to employ a plurality of such antennas.

Another common requirement utilized in conjunction with antennas is directivity. If the transmitting antenna is positioned vertically, the receiving antenna must be positioned vertically. If the transmitting antenna is set horizontally, the receiving antenna must be set horizontally. In other words for the best results, the receiving antenna should be set at exactly the same angle as the transmitting antenna.

In order to diminish the physical size of an antenna, it has been common to utilize an electrically conducted loop. Obviously, a thirty inch loop will assume a size of less than nine and one-half inches in diameter. Using such loops, antenna size can be substantially diminished. For best reception, the plane of the loop should pass through the transmitting signal. Therefore, the performance of a receiver with a loop antenna is directly dependent on the positioning of the antenna.

There is a need to construct an antenna which is sensitive to a wide bandwidth, small in size and which is less sensitive to unwanted radio waves.

SUMMARY OF THE INVENTION

The primary intent of the present invention is to construct an antenna which is sensitive to a wide band of frequencies, which is small in size and which is less sensitive to unwanted radio frequencies.

The antenna of the present invention is constructed of a loop element and a tap element. The tap element is precisely one-half the length of the loop element. Between the terminals of the loop element is located a first capacitor. The tap element is oriented in a closely spaced arrangement with respect to the loop element and is evenly spaced therefrom along the entire longitudinal length of the tap element. The terminals of the tap element are connected to the loop element with a second capacitor being located between the output terminal of the loop element and the output element of the tap element. Between the output terminal of the tap element and the output terminal of the antenna there is located a third capacitor. This resulting antenna can be tuned to any impedance from 1 to 150 ohms for a given band width by merely changing the values of these tuning capacitors. The antenna is specifically constructed to be small in size and to minimize the effect of resonance and, therefore, to be classified as a nonresonant antenna.

BRIEF DESCRIPTION OF THE DRAWING

The FIGURE comprises an electrical schematic view depicting the antenna constructed in accordance with this invention.

DETAILED DESCRIPTION OF THE SHOWN EMBODIMENT

Resonant antennas are inherently sensitive to a narrow bandwidth, generally one percent of the center frequency. The antenna of the present invention is constructed to be inherently selected to wide bandwidths such as between the range of twenty-five percent of the center frequency. The antenna of this invention yields a more efficient design with greater sensitivity than would normally be found in an antenna of this physical size. The integration of tuning capacitors in conjunction with the antenna eliminates the need for a matching transformer which is normally required with conventional antennas. The tuning is performed by the selecting the particular combination of sizes of capacitors 10, 12 and 14. As a result, the bandwidth of the antenna of the present invention exceeds twenty-five percent of the center bandwidth resulting in production of an exceedingly useful antenna design for many applications.

The capacitor 10 is connected between ground terminal 16 and output terminal 18 of the loop element 20 of the antenna of this invention. Capacitor 12 is connected between the output terminal 18 and the output terminal 22 of the tap element 24 of the antenna of this invention. Both the loop element and tap element constitute a thin narrow strip of electrically conductive material and will normally be inscribed on a printed circuit board. Thickness of the loop element 20 and the tap element 24 would be between five and ten mils. Preferable material for the loop element and the tap element 24 would be copper. However, it is considered to be within the scope of this invention that any electrically conductive material would work satisfactorily.

Size is directly related to resonance of an antenna. In order to minimize the effect of resonance, size is to be diminished. Therefore, for an antenna that is constructed to receive 98 mHz which produces 120 inch wave, it is recommended that within this invention the length of the loop element should not exceed one-sixth of one hundred twenty inches or twenty inches. Also, it has been found that the length of the loop element should not be less than one-fifteenth of the wave which is eight inches. This means that the diameter of the loop element 20 should generally be no more than six and one-half inches and no less than two and one-half inches.

The loop element 20 is shown circular within the drawing. However, the loop element 20 could assume any configuration such as hexogonal, octagonal, rectangular and so forth. The tap element 24 is precisely one hundred eighty degrees with respect with the three hundred sixty degree loop element 20. The ground terminal 26 of the tap element 24 is connected directly to the loop element 20 at a point diametrically opposite the terminal 18. It is important that the tap element 24 be closely spaced relative to the loop element 20 such as one-eighth of an inch. The entire length of the tap element 24 is evenly spaced from the loop element 20. The tap element 24 is shown located exteriorly of the loop element 20. However, the tap element 24 could be located interiorly of the loop element 20.

The ground terminal 16 is connected to a ground conductor 28. Connected to the output conductor 22 is an output conductor 30. Within the output conductor 30 is located the capacitor 14. It is to be understood that the conductors 28 and 30 will be connected to an appropriate electrical connector (not shown) such as a conventional plug type of connector which would facilitate connection to a radio receiver.

It is also to be understood that the antenna of this invention will be mounded on a printed circuit board and this printed circuit board will be encased within a housing such as a plastic. The net exterior configuration will be that of a disc resembling a hockey puck. This resulting housing can be mounted in any convenient location with respect to the radio receiver such as on top of it, alongside of it, or whatever. This configuration, generally, has a desirable appearance and, therefore, does not detract from the design of the radio receiver.

Capacitors 10 and 12 together control the output impedance of the loop element 20 such that good impedance matching is to occur over the desired bandwidth. The capacitors 10 and 12 control the resonant characteristic of the tap element 24 with respect to the loop element 20 to determine the tuning of the particular band. Capacitor 10 shunts out of the band higher frequencies from the terminals 16 and 18 and to effectively eliminate those received frequencies. Capacitor 14 serves to block out-of-band lower frequency signals. Capacitor 12 in combination with capacitor 10 tunes the tap element 24 such that the impedance at the center of the bandwidth is at the value desired for antenna operations such as 98 mHz. Away from 98 mHz, the impedance matching is not perfect. However, the impedance matching is good enough to provide similar operation of the antenna over twelve and one-half percent variance from the center bandwidth providing for a total variance of twenty-five percent.

Impedance normally used within radio receivers are fifty and seventy-five ohms. The impedances of a conventional antenna system is generally between three hundred to twelve hundred ohms. As a result, a conventional antenna system requires an impedance matching device such as a transformer. The antenna of the present invention alleviates the need for such a transformer.

The resonant antennas of the prior art have a defined directionality. Using the antenna of the present invention, directionality is of little importance. As a result, antennas of the prior art frequently require adjustment to maximize the sensitivity to a particular signal where the antenna of the present invention is much less sensitive to placement. Resonant antennas of the prior art are somewhat sensitive to multiple signals, principally because of their size. Because of the small size of the antenna of the present invention, such is relatively insensitive to multiple signals. Additionally, resonant antennas of the prior art need to be of a specific length at a given fraction of the center frequency wave length of the bandwidth of the frequency that is being received. Within the present invention, the length of the antenna is not important as long as it is less than one-sixth of the center frequency wave length of the band that is being received. Constructing an antenna in accordance with this invention and to have the antenna receptive to a center frequency of 98 mHz, it has been found that a desirable size for the antenna for the loop element 20 would be four and one-half inches. A desirable size for the capacitors 10, 12 and 14 would be respectively, 2.5 picofarads, 27 picofarads and 47 picofarads.

What is claimed is:

1. An antenna comprising:

an electrically conducted loop element terminating in a first terminal and a second terminal, said first terminal being electrically grounded;

a first capacitor connected between said first terminal and said second terminal;

an electrically conductive tap element mounted directly adjacent to said loop element but spaced therefrom, said tap element being substantially of a length equal to one half the length of said loop element, one end of said tap element connecting directly to said loop element with the other end of said tap element connecting to a third terminal;

a second capacitor connected between said second terminal and said third terminal; and a fourth terminal functioning as the output terminal for said antenna, a third capacitor connected between said third terminal and said fourth terminal.

2. The antenna as defined in claim 1 wherein:

said ends of said tap element being precisely located diametrically opposite relative to said loop element.

3. The antenna as defined in claim 1 wherein:

said tap element being located exteriorly of said loop element.

4. The antenna as defined in claim 1 wherein:

the entire length of said tap element being precisely spaced the same distance from said loop element.

5. The antenna as defined in claim 1 wherein:

said loop element being circular, said tap element being semi-circular.

6. An antenna comprising:

an electrically conducted loop element terminating in a first terminal and a second terminal, said first terminal being electrically grounded;

a first capacitor connected between said first terminal and said second terminal;

an electrically conductive tap element mounted directly adjacent to said loop element but spaced therefrom, said tap element being substantially of a length equal to one half the length of said loop element, one end of said tap element connecting directly to said loop element with the other end of said tap element connecting to a third terminal;

a second capacitor connected between said second terminal and said third terminal;

a fourth terminal functioning as the output terminal for said antenna, a third capacitor connected between said third terminal and said fourth terminal; and said loop element being approximately four and one-half inches in diameter, said first capacitor having a value of 2.5 picofarads, said second capacitor having a value of 27 picofarads, said third capacitor having a value of 47 picofarads.

* * * * *